US008783895B2

(12) United States Patent
Pedersen et al.

(10) Patent No.: US 8,783,895 B2
(45) Date of Patent: Jul. 22, 2014

(54) LED BAR

(75) Inventors: Allan Pedersen, Aarhus C (DK); Xia Chen, Zhuhai (CN); Guohui Li, Zhuhai (CN); Chen Liang, Zhuhai (CN)

(73) Assignee: Martin Professional A/S, Aarhus N (DK)

( * ) Notice: Subject to any disclaimer, the term of this patent is extended or adjusted under 35 U.S.C. 154(b) by 4 days.

(21) Appl. No.: 13/469,549

(22) Filed: May 11, 2012

(65) Prior Publication Data

US 2012/0236555 A1 Sep. 20, 2012

Related U.S. Application Data

(62) Division of application No. 12/676,667, filed as application No. PCT/DK2008/000319 on Sep. 5, 2008, now Pat. No. 8,287,144.

(30) Foreign Application Priority Data

Sep. 5, 2007 (DK) ..... 2007 01267

(51) Int. Cl.

| | |
|---|---|
| ***F21S 4/00*** | (2006.01) |
| ***F21V 29/00*** | (2006.01) |
| ***F21V 13/04*** | (2006.01) |
| ***H05B 33/08*** | (2006.01) |
| ***F21S 10/02*** | (2006.01) |
| ***F21V 23/06*** | (2006.01) |
| *F21V 31/03* | (2006.01) |
| *F21V 5/04* | (2006.01) |
| *F21Y 101/02* | (2006.01) |

(52) U.S. Cl.

CPC ..... *F21V 29/2206* (2013.01); *F21V 29/2293* (2013.01); *F21S 4/008* (2013.01); *F21V 31/03* (2013.01); *F21V 13/04* (2013.01); *H05B 33/0857* (2013.01); *H05B 33/0803* (2013.01); *F21V 29/004* (2013.01); *F21V 5/045* (2013.01); *F21S 10/02* (2013.01); *F21Y 2101/02* (2013.01); *F21V 23/06* (2013.01)

USPC ..... 362/219; 362/221; 362/249.02; 345/690

(58) Field of Classification Search

USPC ..... 362/97.3, 227, 228, 230, 231, 240, 246, 362/249.01, 249.02, 249.05, 249.06, 362/249.12, 249.14, 253, 276, 543, 545, 362/552, 555, 800, 802, 810, 217.01, 362/217.02, 217.1, 217.11–217.17, 219, 362/221–225; 345/1.1, 1.3, 3.3, 31, 55, 82, 345/83, 102, 589, 597, 690, 903; 340/4.3, 340/331, 332, 815.45; 315/291, 294, 312, 315/324, 331, 332; 257/88, 98, 99, 100

See application file for complete search history.

(56) References Cited

U.S. PATENT DOCUMENTS 6,056,420 A 5/2000 Wilson et al.
6,459,919 B1 10/2002 Lys et al.

(Continued)

FOREIGN PATENT DOCUMENTS

EP 1 348 904 A1 10/2003

*Primary Examiner* — Hargobind S Sawhney

(74) *Attorney, Agent, or Firm* — Roberts Mlotkowski Safran & Cole, P.C.; David S. Safran

(57) ABSTRACT

An LED device in which LED groups are located on a pixel board has calibration data for each LED stored both electrically and mechanically close to the actual LED. Preferably, each LED group has a number of LEDs of different colors on the pixel board, being electrically connected to a color controller. The color controller is connected to a power supply, and the pixel board has a memory circuit having the LED calibration data related to the LEDs stored therein. The color controller controls LEDs for generating light based on the LED calibration data stored in the memory circuit on said pixel board. Preferably, at least one of the LEDs is formed on a chip that contains the memory circuit for storing the calibration data.

6 Claims, 12 Drawing Sheets

(56) References Cited

U.S. PATENT DOCUMENTS

| | | | | |
|---|---|---|---|---|
| 6,472,823 | B2 | 10/2002 | Yen | |
| 6,676,284 | B1 * | 1/2004 | Wynne Willson | 362/555 |
| 6,880,952 | B2 | 4/2005 | Kiraly et al. | |
| 7,063,449 | B2 * | 6/2006 | Ward | 362/616 |
| 7,118,248 | B2 | 10/2006 | Wynne Willson | |
| 7,198,387 | B1 | 4/2007 | Gloisten et al. | |
| 7,311,423 | B2 | 12/2007 | Frecska et al. | |
| 7,489,089 | B2 * | 2/2009 | Gandhi | 315/291 |
| 7,557,518 | B2 * | 7/2009 | Zagar et al. | 315/291 |
| 7,744,233 | B2 * | 6/2010 | Moriyasu et al. | 362/97.3 |
| 7,766,511 | B2 | 8/2010 | Zampini et al. | |
| 7,777,166 | B2 * | 8/2010 | Roberts | 250/205 |
| 2002/0114155 | A1 | 8/2002 | Katogi et al. | |
| 2006/0002110 | A1 | 1/2006 | Dowling et al. | |
| 2006/0262545 | A1 | 11/2006 | Piepgras et al. | |
| 2006/0274529 | A1 | 12/2006 | Cao | |
| 2007/0268236 | A1 * | 11/2007 | Morrow | 345/102 |
| 2007/0274067 | A1 | 11/2007 | Sloan et al. | |
| 2008/0225520 | A1 * | 9/2008 | Garbus | 362/231 |
| 2008/0238950 | A1 * | 10/2008 | Saglam | 345/690 |

* cited by examiner

LED BAR

CROSS REFERENCE TO RELATED APPLICATION

This application is a division of commonly owned, co-pending U.S. patent application Ser. No. 12/676,667, and filed Jul. 8, 2010.

BACKGROUND OF THE INVENTION

1. Field of the Invention

The present invention relates to LED bar modules comprising a number of LED groups, which LED groups comprise a number of LEDs, which LEDs have different colours, which LEDs are electrically connected to a colour controller for generating light of changing colour, which colour controller is connected to a power supply, which is formed as a main printed circuit (8), where the LED groups are placed at a pixel board, which pixel board conducts heat from the LEDs.

2. Description of Related Art

The present invention further concerns a method for calibration of LEDs, where the LEDs are connected to control means, which control means control at least one electric parameter used in relation to the operation of the LEDs, where each LED is connected to its own control circuit.

US 2006/0002110 disclose a linear LED housing comprising a top part attached to a bottom part by fasteners. The power and data are fed through the interior of the lighting unit and the top of the housing includes a slot into which light sources are disposed. The housing can be fit with a lens for protecting the light sources or shaping light coming from the light sources. In embodiments the housing may house drive circuitry for a high-voltage and lines for power and data run through the housing. A metal plate conducting heat away from the drive circuit board and the light sources are provided transversal inside the housing. The housing comprises cooling fins on the outside of the housing for additional cooling for the housing. The circuit for high voltage power lines runs through the interior of the housing and there is thus a great risk that current might jump from the high voltage and power lines to the housing causing dangerous ground faults. This risk is increased when the LED housing is used in moist and humid environments (e.g. on a cruse ship where the LED housing might get in contact with saltwater), as moist might enter the housing, as it is difficult to seal the upper and bottom part of the housing, causing corrosion to appear at the electrical circuits and thus increasing the risk of current jumps and ground faults. Further the disclosed housing is very complicated to manufacture, as the outer part comprises of an upper part and bottom part which are fasten together by screws.

It is the object of the invention to achieve a highly efficient LED bar for generating a bar of light. A further object is to form modules of a LED bar which are easy to connect and which by connection automatically connect both power and data. A third object of the invention is to achieve efficient cooling of the LEDs. Yet another object is to achieve an efficient electrical isolation between electronic printed circuits and the bar housing. A further object of the invention is to store calibration data for each LED both electrically and mechanically close to the actual LED. And yet, another object of the invention is to achieve wide orientation scope of LED bar. Another further object is to form modules of LED which is easy to change the diffuser which can fulfil different beam angle out.

SUMMARY OF THE INVENTION

The object of the invention can be fulfilled with a LED bar module having a number of LED groups, each LED group comprising a number of LEDs on a pixel board, the LEDs having different colors and being electrically connected to a color controller, if the main printed circuit is placed inside a heat conductive tube, where the pixel board is placed outside the heat conductive tube in a longitudinal recess, where a connector is electrically connecting the pixel board to the main printed circuit, where the main printed circuit is placed inside an isolation cover, which isolation cover is placed between the main printed circuit and the heat conductive tube, which isolation cover has a longitudinal opening for achieving heat conduction between the main printed circuit and a central part of the upper wall of the heat conductive tube.

Hereby, it is achieved that the LEDs are placed on the outside of the tube in a way where heat generated from the LEDs is conducted downwards to the tube. Inside the tube, the rest of the power electronics and also the light controlling electronics are placed. Placing e.g. switch mode, supply circuits and also control circuits inside a tube gives a highly efficient electromagnetic shield for shielding against electromagnetic radiation to the outside. Placing the electronic printed circuits inside an isolation cover reduces the risk of electrical short cut towards the tube. In all situations where printed circuit boards are to be placed inside a metallic tube, the same problem of how to achieve a highly efficient isolation of the printed circuit board occurs. Problems also occur because the physical size of components can change during production life of a product so components which are bigger in production are replacing the components designed during the developing process of the product. Placing the printed circuit boards inside the isolation cover solves all these problems in a highly efficient way.

The colour controller can be placed on a daughter printed circuit, which daughter printed circuit can be electrically and mechanically connected to the main printed circuit by connectors. Placing the colour controller on a daughter printed circuit can lead to the result that this colour controller could be a module which is used in a number of different products using exactly the same circuit. Placing the colour controller on the daughter printed circuit also leads to a situation where all the intelligence in the light controller can easily be exchanged. In this way, the rest of the printed circuit board can be manufactured as a highly efficient switch mode power supply with sufficient room for a high current connection between at least some of the components.

The pixel board can comprise a memory circuit, in which memory circuit LED calibration data for the LEDs at the board is stored. It is well-known when using LEDs for generating different colours that these LEDs need to be calibrated. The best result is achieved if an intelligent circuit is used where, at first, factory data for the LEDs are known and calibration data are calculated in relation to the number of hours the LED has been in operation. By using these data, it is possible to make an intelligent calibration which is sufficient for the LED for at least a period of operation. Placing these calibration data close to the LEDs assures that the correct data is in place for the right LED during operation. This is especially important with the knowledge that two LEDs do probably not have the same colour result for the same supply current. Therefore, it is necessary to calibrate each individual LED. Recalibration might be performed after a period of operation.

Instead the LEDs can be formed at a chip, which chip further comprises a memory circuit for storing calibration data for the actual LED. As an alternative, the calibration data can be stored in a memory chip which could be formed directly at the LED chip. In this way, the calibration data are stored as close as possible to the actual LED.

A number of LED modules can be connected in order to form a longitudinal LED bar, where each LED bar module comprises female connectors at the first end and male connectors at the second end, which connectors comprise a first group of power connectors and a second group of data connectors. For forming a long LED bar, it is necessary to connect a number of LED modules. This is efficiently achieved by placing male and female connectors in each end of each module. Forming both power bus connections and data bus connections in both ends of a module, it is possible to connect both data and power each time a new module is added to the existing module. By using an intelligent light controller, the controller can exchange data and in this way automatically be programmed to operate in conjunction with the neighbours. By performing a light show where the LED modules react correctly on execution of a programme.

Preferably, two independent data buses are connected between the modules. By using two different data buses, it is possible to let the modules communicate with the DMX protocol and at the same time exchange data over another and more modern communication protocol.

The LED groups can be placed beneath lenses for deflecting generated light in a mainly perpendicular and longitudinal direction of the bar. By using specially designed lenses nearly no light leaves the lenses in a sideward direction in relation to the bar. In the direction perpendicular to the bar, nearly all the light will be radiated in this direction by these lenses. In this way, a bar placed e.g. next to a stage will appear relatively small.

The lenses can be placed in relation to reflectors, which reflectors deflect the light in a mainly perpendicular and longitudinal direction in relation to the bar. If reflectors are used, the light transmitted from lenses in the longitudinal directions of the bar can be deflected by reflectors in a direction perpendicular to the longitudinal axis of the bar. Using the reflectors, fewer LED groups are probably necessary for forming a perfect lighting bar.

Hereby, it can be achieved that the actual calibration data is stored in relation to the actual colour group. The calibration data is stored at the same pixel board as the colour group. In this way, the calibration data follows the colour group in both initial tests, during normal use and during repair. Hereby, pixel boards are replaceable without performing any start-up calibration.

The calibration data for each colour group can comprise at least storage of operational time in relation to the actual colour group power level. Hereby, the wear-out of each colour group can be calculated, and the electric supply parameters for each LED can be adjusted in relation to the wear-out.

The operational time in relation to the actual power level can be stored in a two-dimensional historic file in the calibration data storage. Hereby, only a small number of data needs to be stored in the calibration memory.

The rotation of LED bar can be fulfilled manually through an integrated pivot which is placed at both ends of LED bar modules. When the anticipated angle is reached, rotate the knob which is on the bottom of bracket to secure the position. The angle of the LED bar is capable of being rotated from 0° to 360° freely.

By adding the different diffuser film in front of Lens will change beam spread angle. A diffuser film with a certain angle can be hold by a pair of chimps which is located inside the front cover and it is easily removable for alternative.

DETAILED DESCRIPTION OF THE INVENTION

Figure 1:
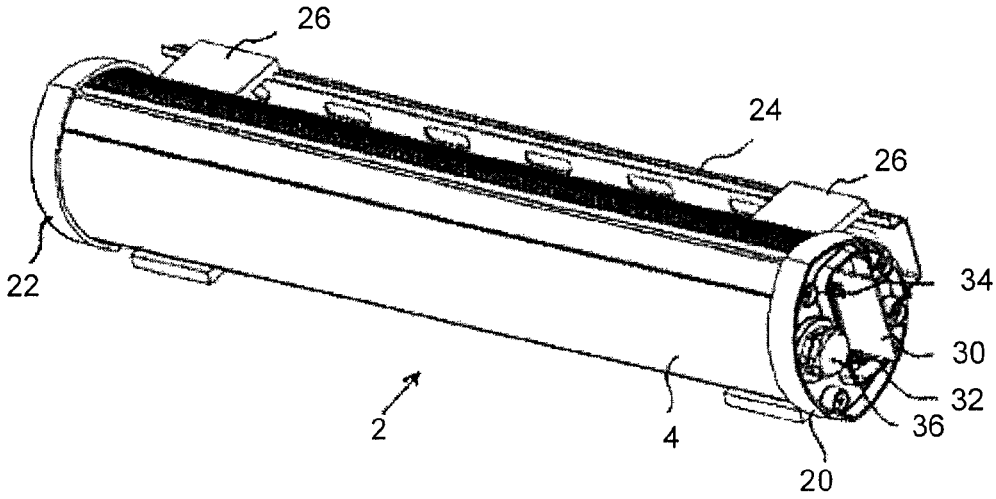
FIG. 1 shows a LED bar module

FIG. 1 shows a LED bar module 2 comprising a tube 4 in which tube 4 lighting means in form of LEDs are placed together with control electronics for controlling the light emission of the LEDs. Furthermore, FIG. 1 shows a first end plate 20 and a second end plate 22. A fixture 24 is connected to framing means 26. A printed circuit connector 30 and two bus connectors 32 and 34 are also shown. Furthermore, in this figure, a valve 36 is shown which valve comprises a diaphragm which diaphragm only allows humidity to pass in the direction inside out from the LED module 2.

In operation, power will be connected to the LED module 2 by the connector 30 and data will be connected to connectors 34 or 36. Thus, the LED module will receive sufficient power and information to start performing a light show where colour change is only one of several possibilities.

Figure 2:
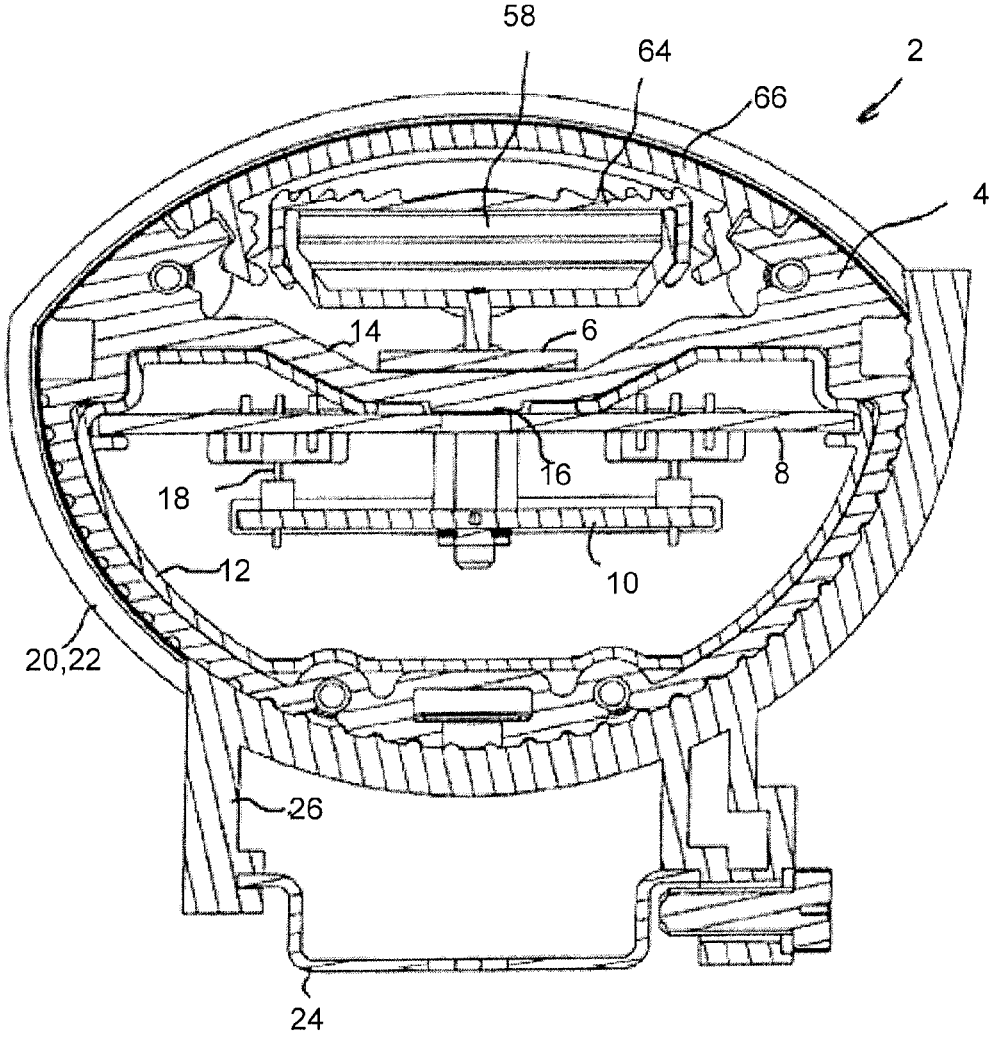
FIG. 2 shows a sectional view of a LED bar

FIG. 2 shows a sectional view of a LED bar 2. In a cavity 14, the housing 4 forms a seat for the pixel board 6 which is heat conductively connected to the tube 4. Inside the tube 4 in the cavity, a main printed board 8 and a daughter printed board 10 are shown. Both printed boards 8 and 10 are placed inside an isolation cover 12 which isolation cover 12 has an opening 60 (FIG. 6) in which a protrusion 16 of the tube 4 is heat conductively connected to the main printed circuit board 8. The daughter circuit board 10 is connected to the main printed circuit board 8 by a connector 18. Outside the tube 4, first and second end covers 20 and 22 are indicated. Over the pixel board 6, reflectors 58 are seen which reflectors 58 are placed beneath a cover 64, and a second cover 66, which is formed of clear plastic such as poly carbonate. The second cover 66, seals the tube 4. At the outside, the tube 4 is connected to a frame 26 which is further connected to holding means 24.

In operation, the heat generated at the pixel board 6 will be conducted into the tube 4. Further heat produced at the main printed circuit board 8 will also be conducted into the tube 4. The tube 4 as such is heat conductively connected to the frame 26 from where the heat is radiated or converted outside to the surroundings.

Figure 3:
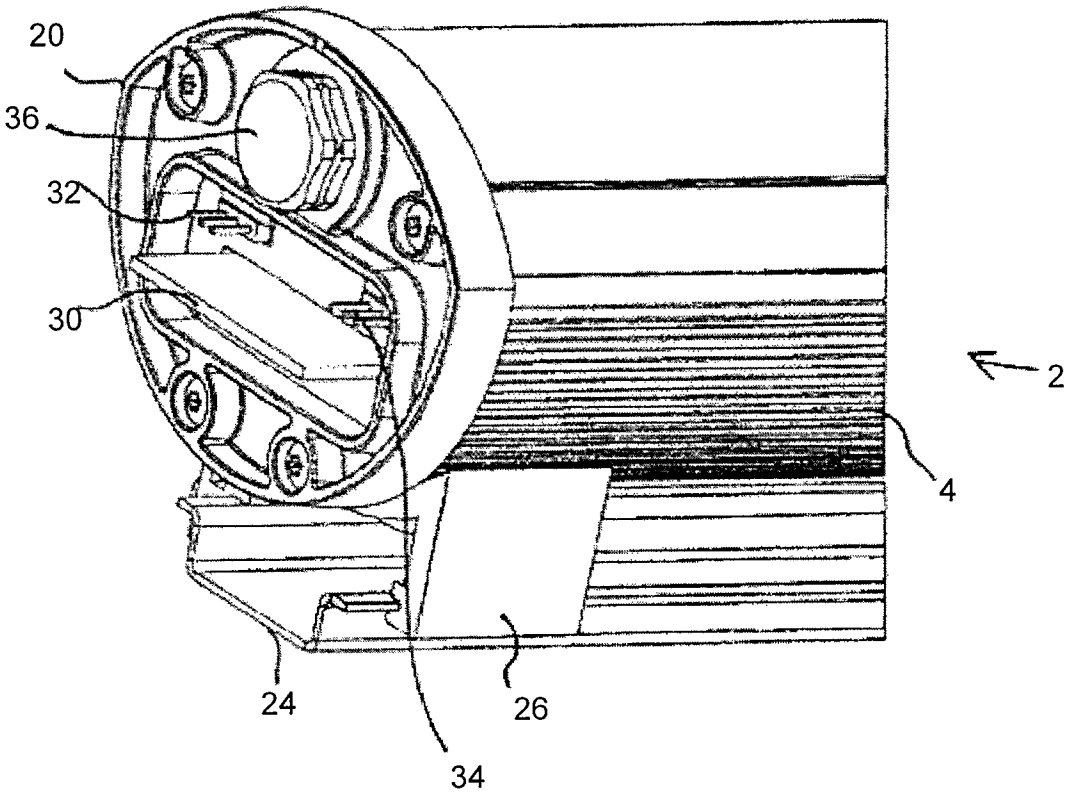
FIG. 3 shows a LED bar 2 seen from a first end

FIG. 3 shows a LED bar 2 seen from a first end. FIG. 3 shows the tube 4 connected to the first end cover 20. The tube 4 is connected to a frame 26 which is further connected to a holder 24. A printed circuit board connector 30 is seen and above the PCB connector 30, two data bus connectors 32 and 34 are seen. Furthermore, a valve 36 is seen comprising a diaphragm which only allows humidity to pass from the inside to the outside of the tube.

In operation, the valve 36 allows air to pass from inside out which takes place each time the LED module is connected to power and starts to operate. The module heats up, and air flows out of the operators. After shutting down, the LED module will start cooling down, and air from the outside will be sucked into the cavity. As the air subsequently passes through the diaphragm in the valve 36, humidity is left outside and in this way the internal volume will be kept dry.

Figure 4:
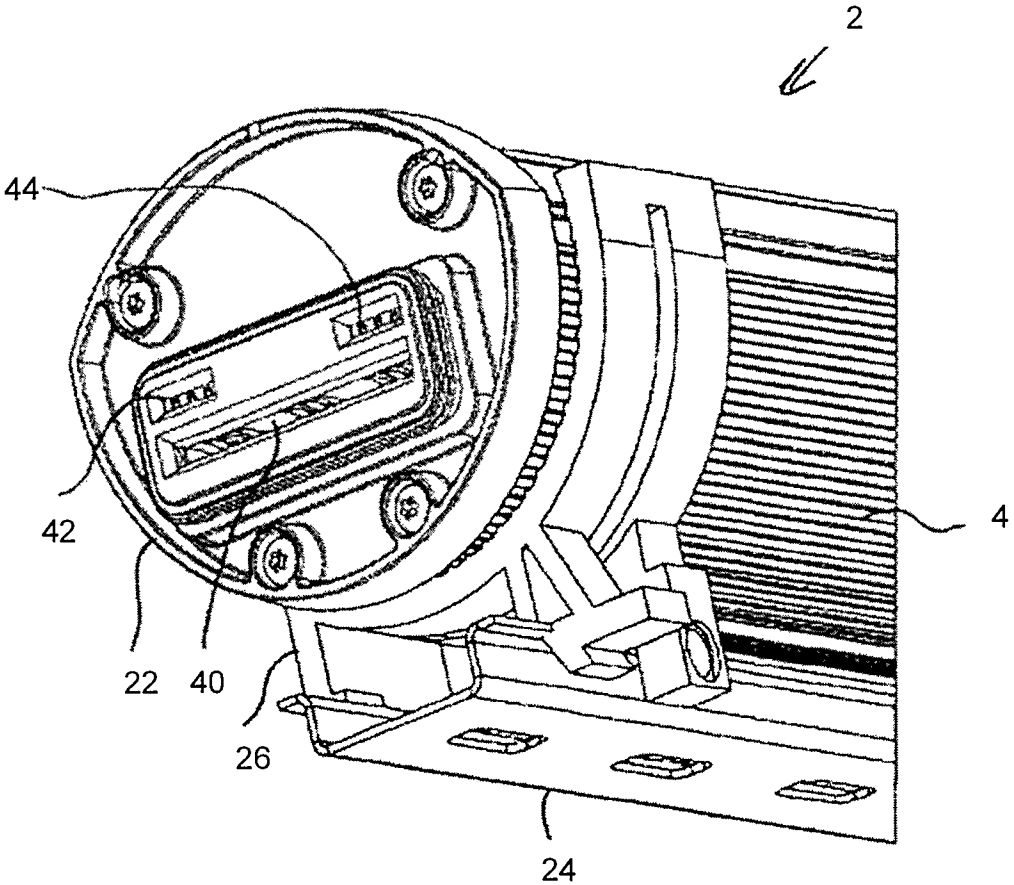
FIG. 4 shows the opposite end of a LED module

FIG. 4 shows the opposite end of a LED module 2, and this time the second end cover 22 is indicated. Again the tube 4 is mechanically connected to framing means 26 which are connected to a holder 24. The end cover shows a female printed circuit board connector 40 and female data bus connectors 42 and 44.

Combining FIG. 4 and FIG. 3, it is clear that two or more LED modules can be coupled serial to form a relatively long tube.

Figure 5:
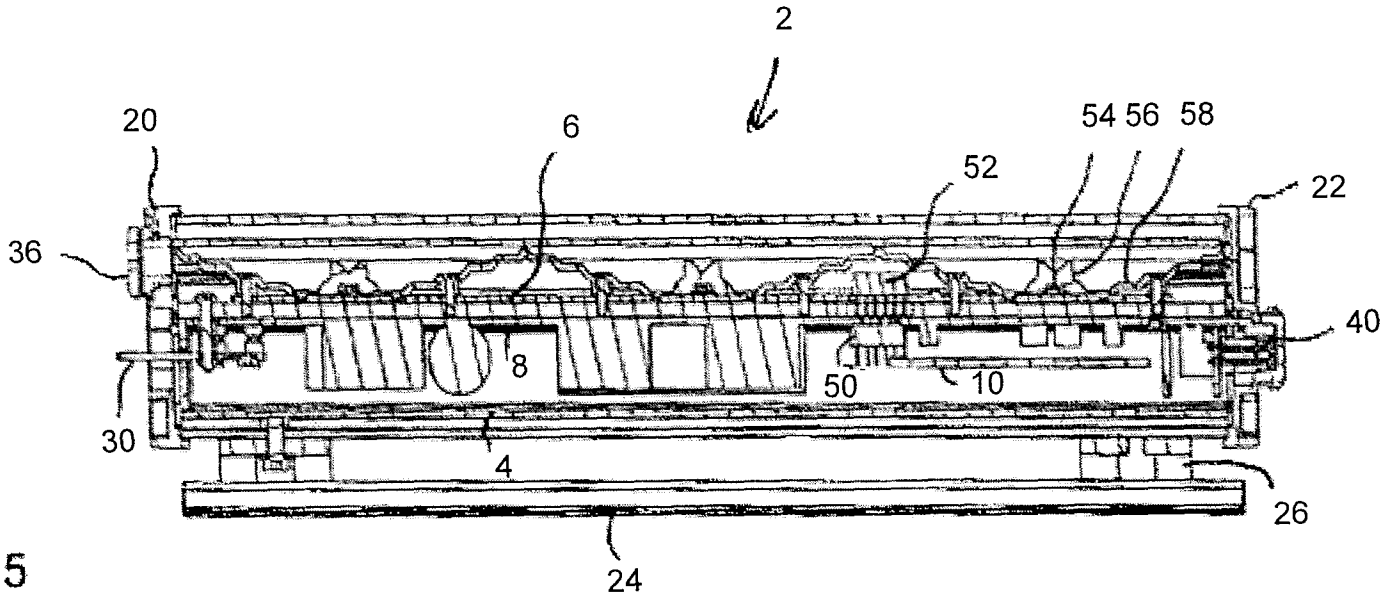
FIG. 5 shows a longitudinal sectional view of a LED bar

FIG. 5 shows a longitudinal sectional view of a LED bar 2 which bar is formed of a tube 4. Inside the tube, a pixel board 6 and a main printed circuit board 8 are indicated. Furthermore, a daughter printed circuit board 10 is seen. At a first end, an end cover 20 is seen and at the opposite end, an end cover 22 is seen. Beneath the tube 4, a frame 26 and a holder 24 are seen. At the first end, a printed circuit board connector 30 and valve 36 are indicated. At the other end, the female connector 40 is seen. Inside the tube, connectors 50 and 52 are seen which are electrically interconnecting the main board 8 and the pixel board 6. Furthermore, at the pixel board, LEDs 54 are seen which are placed beneath lenses 56 which lenses 56 are cooperating with reflectors 58.

Light generated from LEDs 54 is at first deflected by lenses 56 in a direction which is longitudinal in relation to the bar. The light which leaves the lenses 56 is then reflected upwards by reflectors 58 with the result that the light leaving the bar is mainly transmitted perpendicular to the bar. By forming the reflectors 58 as a long section with steps between forming reflecting surfaces at the steps, it is possible to let a single group of LEDs light up a relatively long distance of the module. In this way, this module only indicates three groups of LEDs. But seen from the outside, the LED will light up the whole bar.

Figure 6:
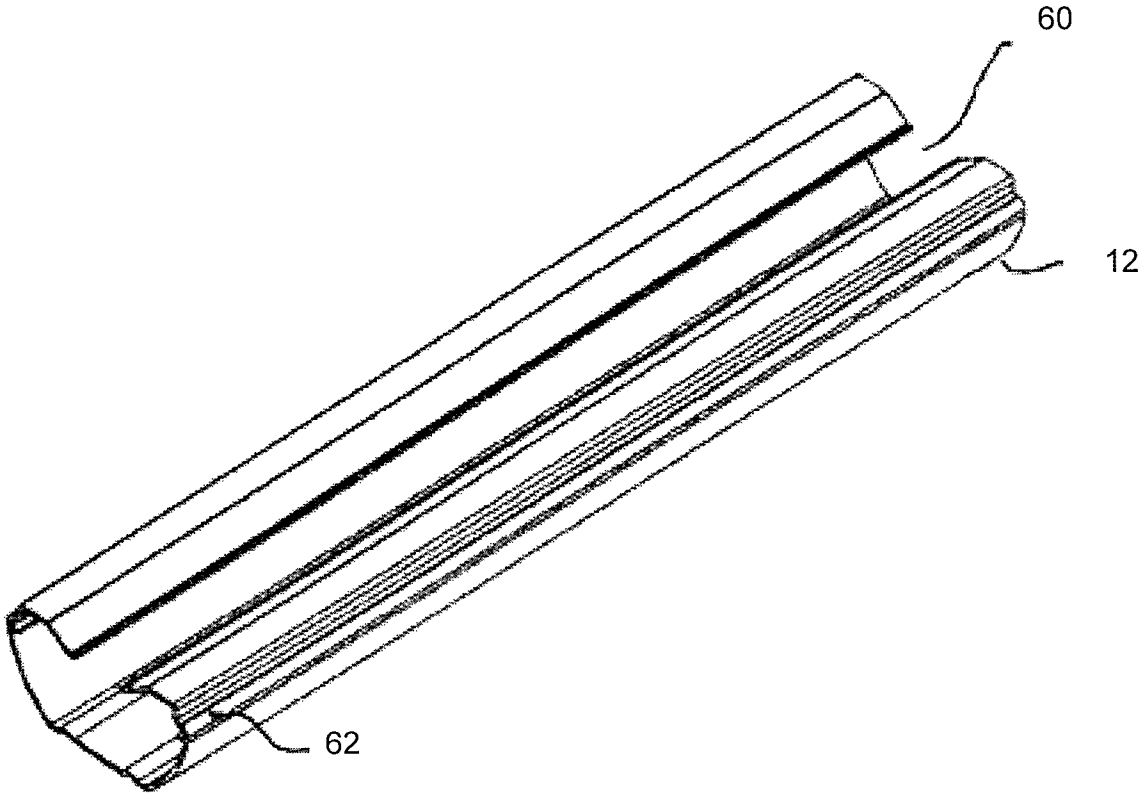
FIG. 6 shows an isolating cover

FIG. 6 shows an isolating cover 12 which isolating cover has a longitudinal opening 60. Furthermore, the isolation cover 12 has a recess 62 at both sides which cooperates with the inner contour of the tube 4 seen in FIG. 2.

Figure 7:
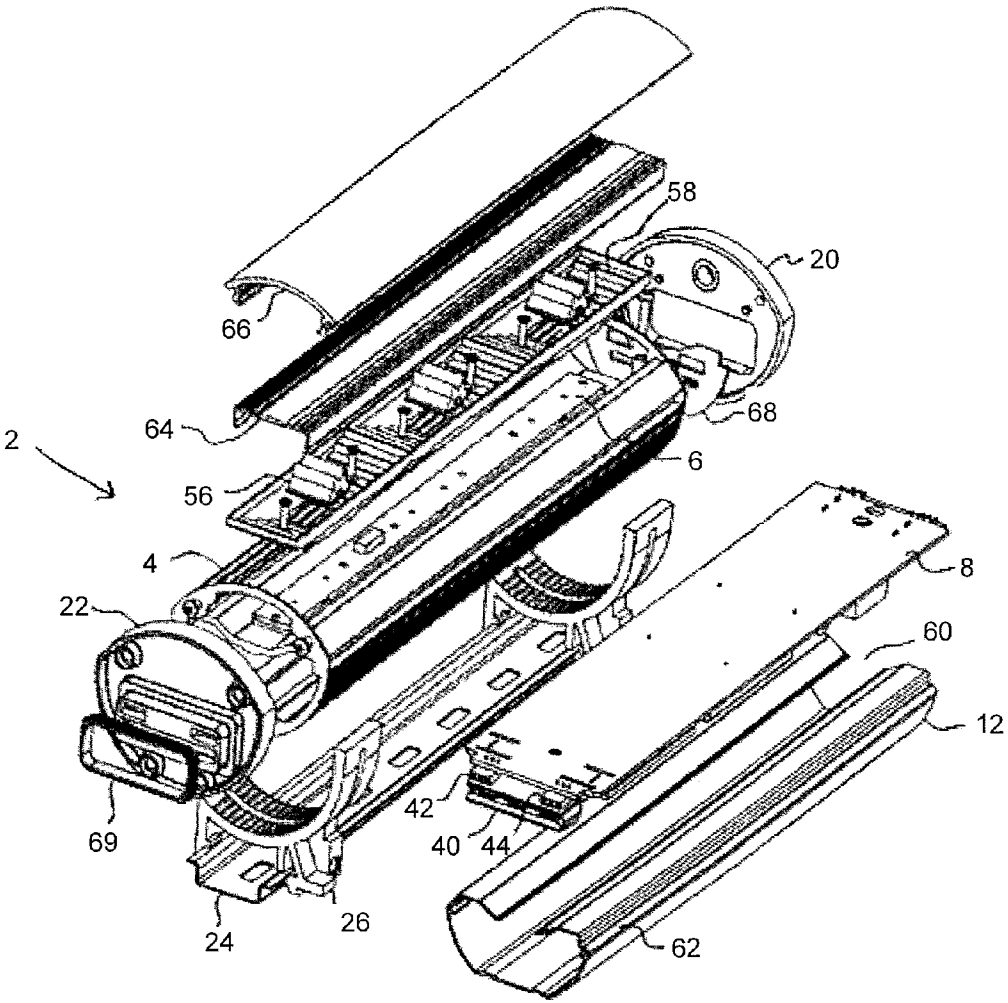
FIG. 7 shows an exploded view of the LED bar

FIG. 7 shows an exploded view of the LED bar 2 which comprises a tube 4 where a pixel board 6 is placed in a recess in the tube 4. Inside the tube 4 in a cavity, a main printed circuit board 8 is placed inside an isolation cover 12. The tube 4 is connected to a first end cover 20 and a second end cover 22. Furthermore, the tube 4 is connected to a frame 26 which frame is further connected to a holder 24. At the end of the printed main circuit board 8, female connectors 40 for power and further female data connectors 42 and 44 are seen. Over the pixel board 6, lenses 56 and reflectors 58 are seen. Above the reflectors 58, a first cover 64 and a second plastic cover 66 are indicated. The isolation cover 12 comprises an opening 60 and the recess 62. Furthermore, an end cover 69 is indicated which is cooperating with the end cover 22.

Figure 8:
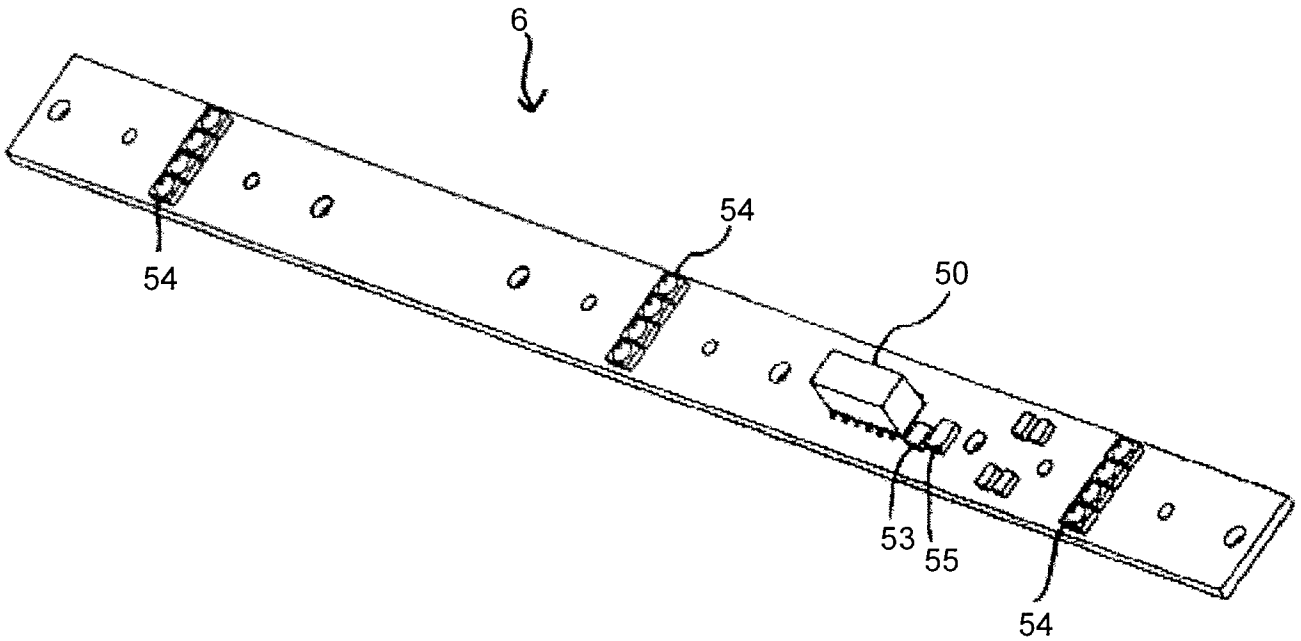
FIG. 8 shows a pixel board

FIG. 8 shows a pixel board 6 on which pixel board a connector 50 is indicated. Furthermore, at the pixel board, LEDs 54 are seen which are placed in groups where each group comprises four LEDs. In addition, memory components 53 and 55 for storing LED calibration data at the board are shown.

Figure 9:
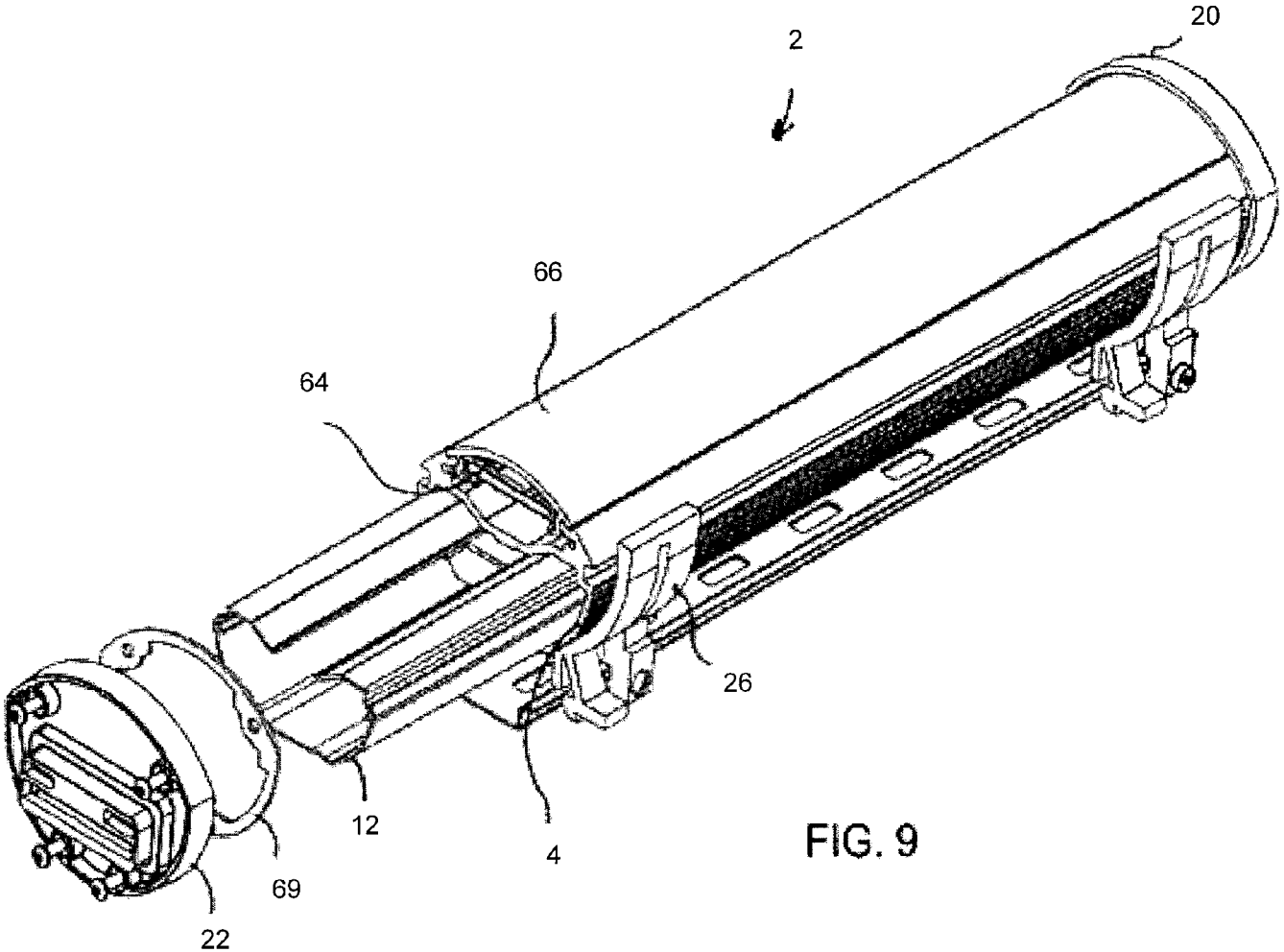
FIG. 9 shows a LED bar 2 seen partly opened in one end

FIG. 9 shows a LED bar 2 which is partly opened in one end. The tube 4 is seen and inside the tube 4, the isolation cover 12 is indicated which comprises the main printed circuit board. Also, the frame 26 is seen outside the tube 4. The end cover 20 covers the first end of the tube and the second end cover is supposed to cover the other end when the tube is correctly assembled. The top cover which is made of a clear plastic 66 is seen and below that cover, the cover 64 is also indicated.

Figure 10:
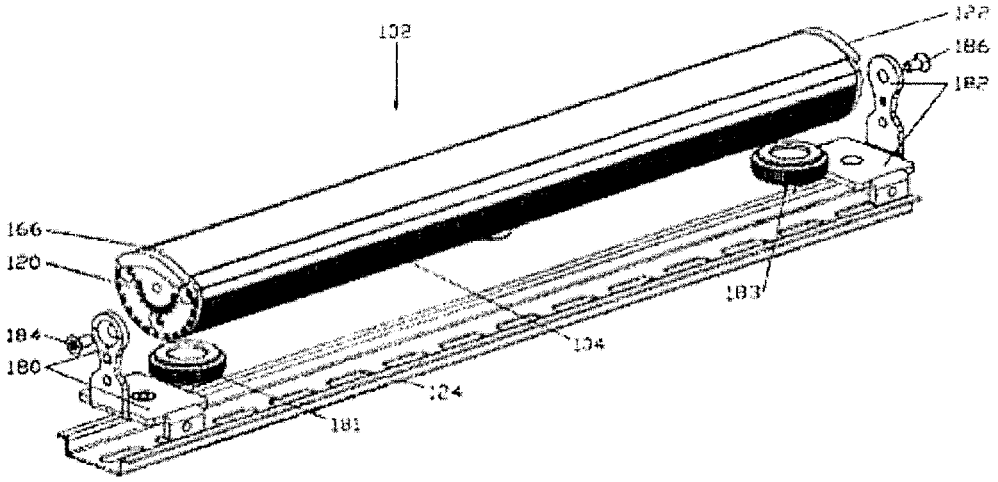
FIG. 10 shows an exploded perspective view of another embodiment of LED bar module.
Figure 11:
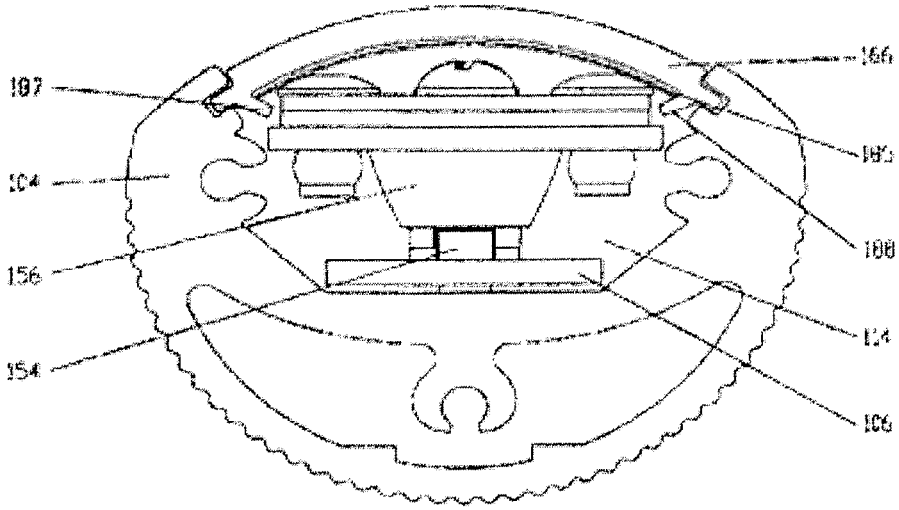
FIG. 11 shows a cross section view of another embodiment of LED bar module with chimbs.
Figure 12:
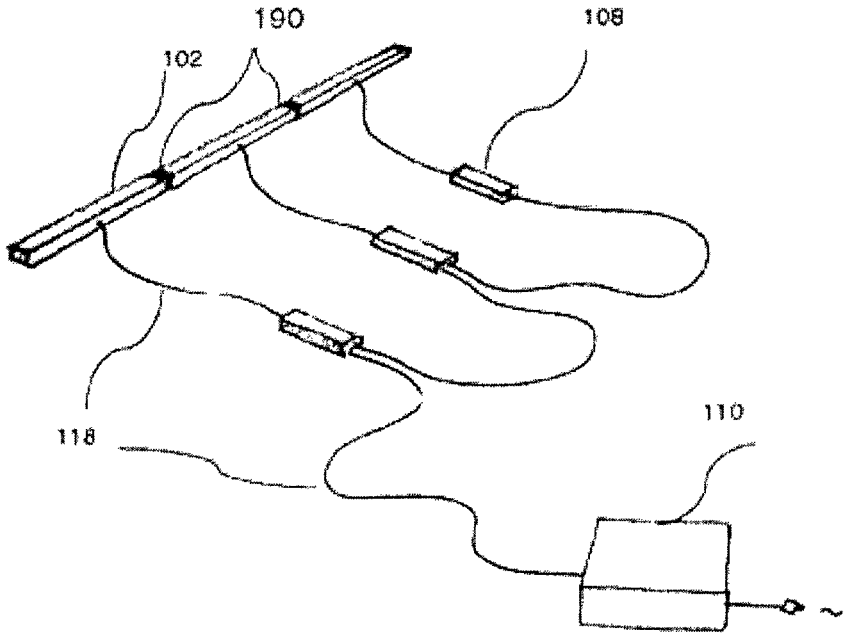
FIG. 12 shows a plurality of another embodiment LED bar modules combined together.

FIGS. 10, 11 and 12 show another embodiment of the invention. From FIG. 10 and FIG. 12, it is seen that LED bar modules 102 comprising a heat conductive tube 104, in which tube 104 and lighting means in form of LEDs are placed together. Power supply 108 and colour controller 110 for controlling the light emission of the LEDs are placed outside of the LED bar modules 102. Furthermore, FIG. 10 shows a first end plate 120 and a second end plate 122. A first pivot 184 and a second pivot 186 connect the LED bar modules to rail 124 through the first bracket 180 and the second bracket 182. Two knobs 181 and 183 are on the seat of the bracket 180 and 182. LED bar modules 102 is capable of being rotated manually around the dual pivot 184 and 186. After the anticipated position is reached, to move the knob 181 and 183 toward the tube 104 to fasten or away the tube 104 to loosen can secure the orientation.

In operation, power and data will be connected to the LED module 102 by the cable 118. Thus, the LED module will receive sufficient power and information to start performing a light show where colour change is only one of several possibilities.

FIG. 11 shows a cross-section view of a LED bar 2. In a recess 114, the tube 4 forms a seat for the pixel board 106 which is heat conductively connected to the tube 106. Over the pixel board 106, a LEDs 154 can be placed beneath lenses 156 for deflecting generated light, diffuser 185 is seen which is placed beneath a cover 166 which is formed of transparent or translucent plastic such as poly carbonate.

In operation, the heat generated at the pixel board 106 will be conducted into the tube 104. The tube 104 as such is heat conductively connected to the bracket of integrated pivot and further connected to a rail 124 from where the heat is radiated or converted outside to the surroundings.

A pair of chimbs 187 and 188 is placed inside of the cover 166 to hold the diffuser 185. A diffuser film 185 with a certain light angle can be hold by the chimbs. By adding the different diffuser film in front of Lens will change beam spread angle from 20° to 40°, 60° and 120° or any other. When moving away the first end plate 120 and the second plate 122, it is easily removable for changing different diffuser films, thus alternative.

FIG. 12 shows a plurality of LED bar modules 102 are combined together to form a long strip light. The LED bar modules 102 can be aligned through a clamp 190. The cable 118 integrated power and data is extended from the inside of the tube 104 to the power supply 108 and colour controller 110 which are placed outside of the tube 104. Preferably, the cable 118 is a CAT5e network cable. Sometimes the colour controller 110 can be a common controller for an array of LED bar modules.

What is claimed is:

1. LED device comprising a number of LED groups, each LED group comprising a number of LEDs on a pixel board, said LEDs having different colors and being electrically connected to a color controller, wherein said color controller is connected to a power supply, and wherein said pixel board is separated from said color controller and comprises a memory circuit having LED calibration data related to said LEDs stored therein and wherein the power supply is located on a main circuit board and the color controller is located on a daughter circuit board, and wherein the daughter circuit board is electrically and mechanically connected to the main circuit board in a manner enabling replacement or exchange of the daughter circuit board independent of the main circuit board.

2. LED device according to claim 1, wherein said color controller is adapted to control said LEDs for generating light based on said LED calibration data stored in the memory circuit on said pixel board.

3. LED device according to claim 2, wherein the stored LED calibration data comprises operational time in relation to the actual LED power level and wherein said color controller is adapted to control said LEDs based on said operational time in relation to the actual LED power level.

4. LED device according to claim 3, wherein said operational time in relation to the actual LED power level are stored as a two-dimensional historic file.

5. LED device according to claim 1, wherein at least one of said LEDs is formed at a chip, and wherein said chip contains said memory circuit for storing said calibration data.

6. LED device comprising a number of LED groups, each LED group comprising a number of LEDs on a pixel board, said LEDs having different colors and being electrically connected to a color controller, wherein said color controller is connected to a power supply, and wherein said pixel board is separated from said color controller and comprises a memory circuit having LED calibration data related to said LEDs stored therein and wherein at least the power supply is located on a main circuit board, wherein the main circuit board is located inside a heat conductive tube, wherein the pixel board is located outside of the heat conductive tube in a longitudinal recess of the heat conductive tube, and wherein a connector electrically connects the pixel board to the main circuit board.

* * * * *